US008483016B2

(12) United States Patent
Tokiwa et al.

(10) Patent No.: US 8,483,016 B2
(45) Date of Patent: Jul. 9, 2013

(54) TIME INFORMATION ACQUIRING APPARATUS AND RADIO-CONTROLLED TIMEPIECE

(75) Inventors: Teruhisa Tokiwa, Kunitachi (JP); Takashi Sano, Fussa (JP)

(73) Assignee: Casio Computer Co., Ltd, Tokyo (JP)

( * ) Notice: Subject to any disclaimer, the term of this patent is extended or adjusted under 35 U.S.C. 154(b) by 224 days.

(21) Appl. No.: 13/182,532

(22) Filed: Jul. 14, 2011

(65) Prior Publication Data

US 2012/0026841 A1 Feb. 2, 2012

(30) Foreign Application Priority Data

Jul. 28, 2010 (JP) ..... 2010-168827

(51) Int. Cl.
*G04C 11/02* (2006.01)

(52) U.S. Cl.
USPC ..... 368/47

(58) Field of Classification Search
USPC ..... 368/47
See application file for complete search history.

(56) References Cited

U.S. PATENT DOCUMENTS

2006/0050824 A1 3/2006 Kondo
2009/0248357 A1 10/2009 Abe

FOREIGN PATENT DOCUMENTS

JP 10-082874 3/1998
JP 2006-337048 12/2006
JP 5099185 10/2012

OTHER PUBLICATIONS

Extended European Search Report for European Application No. 11175785.2-1240 mailed on May 18, 2012.

*Primary Examiner* — R S Luebke
*Assistant Examiner* — Jason Collins
(74) *Attorney, Agent, or Firm* — Turocy & Watson, LLP

(57) ABSTRACT

Disclosed is a time information acquiring apparatus wherein: a second data acquiring section acquires a second data by measuring pulse signals of a frame of a time code signal during a period of time including a period of time a first data acquiring section acquires a first data which is stored in a first data storing section; and when a time data, which is generated by a decoder based on information on a starting point of the frame detected by a detecting section and the second data stored in a second data storing section, is determined as inconsistent by a consistency determining section, a controller makes the detecting section re-detect the starting point of the frame, and makes the decoder re-generate the time data based on a result of the re-detection of the starting point of the frame and the second data stored in the second data storing section.

9 Claims, 10 Drawing Sheets

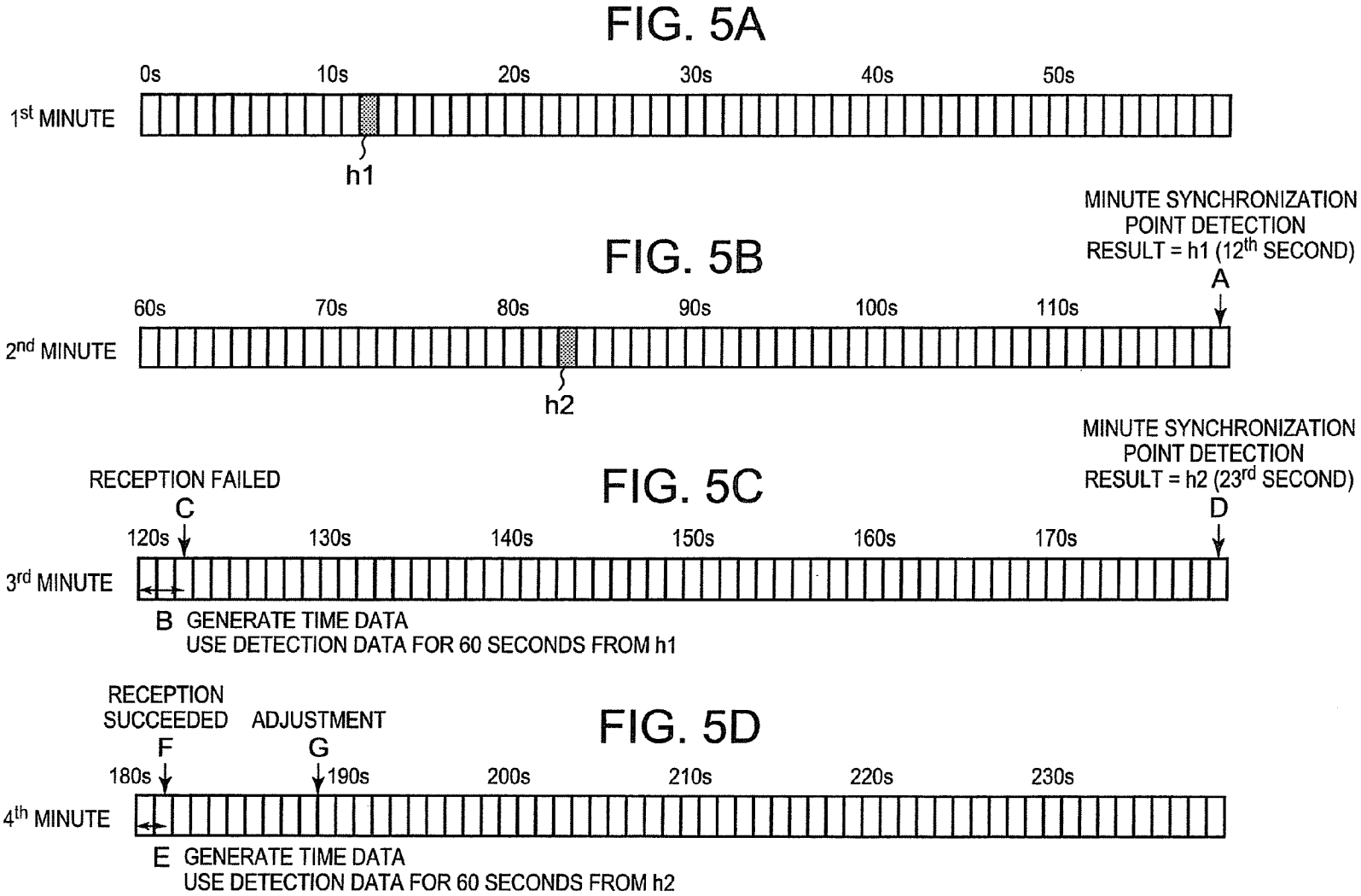
FIG. 5A
1st MINUTE
0s
10s
20s
30s
40s
50s
h1
FIG. 5B
2nd MINUTE
60s
70s
80s
90s
100s
110s
h2
MINUTE SYNCHRONIZATION POINT DETECTION RESULT = h1 (12th SECOND)
A
FIG. 5C
3rd MINUTE
120s
130s
140s
150s
160s
170s
RECEPTION FAILED
C
B GENERATE TIME DATA USE DETECTION DATA FOR 60 SECONDS FROM h1
MINUTE SYNCHRONIZATION POINT DETECTION RESULT = h2 (23rd SECOND)
D
FIG. 5D
4th MINUTE
180s
190s
200s
210s
220s
230s
RECEPTION SUCCEEDED
F
ADJUSTMENT
G
E GENERATE TIME DATA USE DETECTION DATA FOR 60 SECONDS FROM h2

TIME INFORMATION ACQUIRING APPARATUS AND RADIO-CONTROLLED TIMEPIECE

BACKGROUND OF THE INVENTION

1. Field of the Invention

The present invention relates to a time information acquiring apparatus to which a time code signal included in a standard radio wave is inputted so as to acquire time information, and to a radio-controlled timepiece including the time information acquiring apparatus.

2. Description of the Related Art

There is known a conventional radio-controlled timepiece which, in order to generate time data by receiving a standard radio wave (standard time and frequency signal), first, detects a second synchronization point (0.00 sec., 1.00 sec., to 59.00 sec.) of a time code signal extracted from the standard radio wave, second, detects a minute synchronization point (x min. 00 sec., the "x" is an arbitrary value of minutes) thereof, and third, perform a code determination thereof based on the second synchronization point and the minute synchronization point so as to generate time data.

For example, Japanese Patent Application Laid-open Publication No. 2006-337048 discloses a configuration which performs a code determination with respect to a signal waveform demodulated from the standard radio wave, stores the data of the code determination result, detects an accurate minute position (minute synchronization point) based on the stored data, and generates time data based thereon.

However, in such a conventional method for generating time data, when the generated time data is determined as inconsistent, it has to be redone from the minute synchronization point detecting process. Therefore, the data of the time code signal acquired by then becomes useless, and hence it takes a long time until accurate time data is acquired.

The configuration disclosed in Japanese Patent Application Laid-open Publication No. 2006-337048 also requires starting over from the code determination with respect to the signal waveform by receiving the standard radio wave when the generated time data is determined as wrong time data.

The present invention provides a time information acquiring apparatus and a radio-controlled timepiece which, even when the minute synchronization point is wrongly detected, can promptly acquire accurate time data by correcting the minute synchronization point without wasting the data acquired by then.

SUMMARY OF THE INVENTION

An aspect of the present invention is a time information acquiring apparatus including: a first data acquiring section which acquires a first data for detecting a starting point of a frame of a time code signal by measuring pulse signals of the frame of the time code signal which is extracted from a standard radio wave so as to be inputted; a first data storing section which stores the first data acquired by the first data acquiring section; a detecting section which detects the starting point of the frame of the time code signal based on the first data stored in the first data storing section; a second data acquiring section which acquires a second data for distinguishing the pulse signals from each other by measuring the pulse signals of the frame of the time code signal during a period of time including a period of time the first data acquiring section acquires the first data; a second data storing section which stores the second data acquired by the second data acquiring section; a decoder which decodes a series of code strings of the time code signal based on information on the starting point of the frame of the time code signal, the information which is acquired by detecting the starting point of the frame by the detecting section, and based on the second data stored in the second data storing section, so as to generate time data; a consistency determining section which determines consistency of the time data generated by the decoder; and a controller which, when the generated time data is determined as inconsistent by the consistency determining section, makes the detecting section re-detect the starting point of the frame, and makes the decoder re-generate the time data based on a result of the re-detection of the starting point of the frame and the second data stored in the second data storing section.

BRIEF DESCRIPTION OF THE DRAWINGS

FIGS. 5A to 5D are time charts showing the specific example of the minute synchronization detecting and decoding process;

DESCRIPTION OF THE PREFERRED EMBODIMENT

In the following, an embodiment of the present invention is described with reference to the accompanying drawings.

Figure 1:
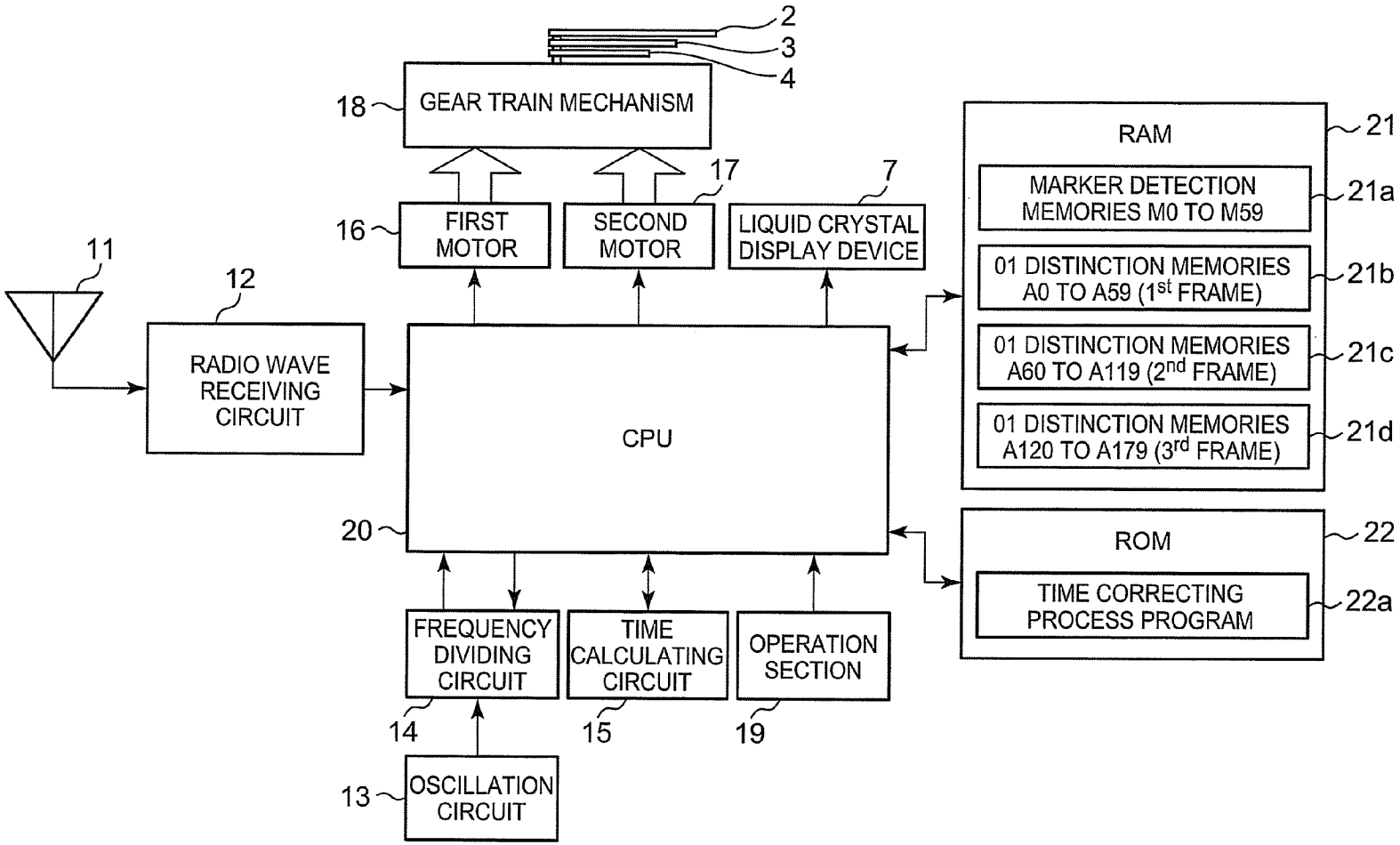
FIG. 1 is a block diagram showing the overall configuration of a radio-controlled timepiece according to an embodiment of the present invention.

FIG. 1 is a block diagram showing the overall configuration of a radio-controlled timepiece 1 according to an embodiment of the present invention.

The radio-controlled timepiece 1 according to the embodiment is an electronic timepiece having a function of receiving a standard radio wave including a time code so as to automatically correct the time. The radio-controlled timepiece 1 displays the time by hands (a second hand 2, a minute hand 3, and an hour hand 4) which revolve on a dial plate, and by a liquid crystal display device 7 which is disposed on the dial plate, and displays various information. The hands 2, 3, and 4 and the liquid crystal display device 7 function as a time displaying section.

As shown in FIG. 1, the radio-controlled timepiece 1 includes an antenna 11 which receives the standard radio wave, a radio wave receiving circuit (radio wave receiving section) 12 which demodulates the standard radio wave so as to generate a time code signal, an oscillation circuit 13 and a frequency dividing circuit 14 as a timer circuit which generates various timing signals, a time calculating circuit (time calculating section) 15 which calculates the current time, a first motor 16 which drives the second hand 2 to revolve, a second motor 17 which drives the minute hand 3 and the hour hand 4 to revolve, a gear train mechanism 18 which transmits the rotational driving force of the first motor 16 and the second motor 17 to their respective hands, an operation section 19 having a plurality of operation buttons, the operation section 19 through which an operation command is inputted from outside, a CPU (Central Processing Unit) 20 as a controller which controls the radio-controlled timepiece 1 as a whole, a RAM (Random Access Memory) 21 which provides a memory space for the CPU 20 to work, and a ROM (Read-Only Memory) 22 which stores pieces of control data and control programs. A time information acquiring apparatus according to the embodiment of the present invention is composed of the CPU 20, the RAM 21, the ROM 22, the frequency dividing circuit 14, and the time calculating circuit 15.

The first motor 16 and the second motor 17 are stepping motors. The first motor 16 drives the second hand 2 to revolve stepwise, and the second motor 17 drives the minute hand 3 and the hour hand 4 to revolve stepwise, independently from each other. On a normal condition to display the time, the first motor 16 is driven one step every one second so as to drive the second hand 2 to make one revolution in one minute. The second motor 17 is driven one step every 10 seconds so as to drive the minute hand 3 to make one revolution in 60 minutes, and to drive the hour hand 4 to make one revolution in 12 hours.

The radio wave receiving circuit 12 includes an amplifier which amplifies a signal received by the antenna 11, a filter which extracts only a frequency content corresponding to the standard radio wave from the received signal, a demodulator which demodulates the received signal so as to extract a time code signal, the received signal of which the amplitude is modulated, and a comparator which performs waveform shaping on the time code signal so as to make the time code signal a signal of a high level and a low level, and outputs the signal outsides. Although not particularly limited, the radio wave receiving circuit 12 is configured as a low active output by which the output is a low level when the amplitude of the standard radio wave is large, and the output is a high level when the amplitude of the standard radio wave is small.

The frequency dividing circuit 14 is capable of changing a value of the frequency-dividing ratio to another value thereof when receiving a command from the CPU 20. Furthermore, the frequency dividing circuit 14 is capable of outputting various timing signals to the CPU 20 in parallel. For example, the frequency dividing circuit 14 generates a one-second cycle timing signal and supplies the signal to the CPU 20 in order to update time calculation data of the time calculating circuit 15 on a one-second cycle, while generating a sampling-frequency timing signal and supplying the signal to the CPU 20 when taking in a time code signal outputted from the radio wave receiving circuit 12.

In the ROM 22, as the control programs, a time displaying process program by which the current time is calculated while the current time is displayed by driving the hands (the second hand 2, the minute hand 3, and the hour hand 4) and the liquid crystal display device 7, a time correcting process program 22*a* by which the time is automatically corrected by receiving the standard radio wave, and the like are stored.

The RAM 21 includes a storage region 21*a* (first data storing section) having marker detection memories M0 to M59 which are used, in a time correcting process, for detecting marker signals included in a time code signal, and a storage regions 21*b* to 21*d* (second data storing section) having 01 distinction memories A0 to A179 which are used, in the process, for performing a code determination of pulse signals of the time code signal. The marker detection memories M0 to M59 are composed of 60 storing sections which are respectively correlated with the pulse positions of 60 pulse signals in a length of one frame of the time code signal. The 01 distinction memories A0 to A179 are composed of 180 storing sections which are capable of storing detection data of 180 pulse signals included in a length of three frames of the time code signal.

[Time Correcting Process]

Next, the time correcting process performed in the radio-controlled timepiece 1 is described.

Figure 2:
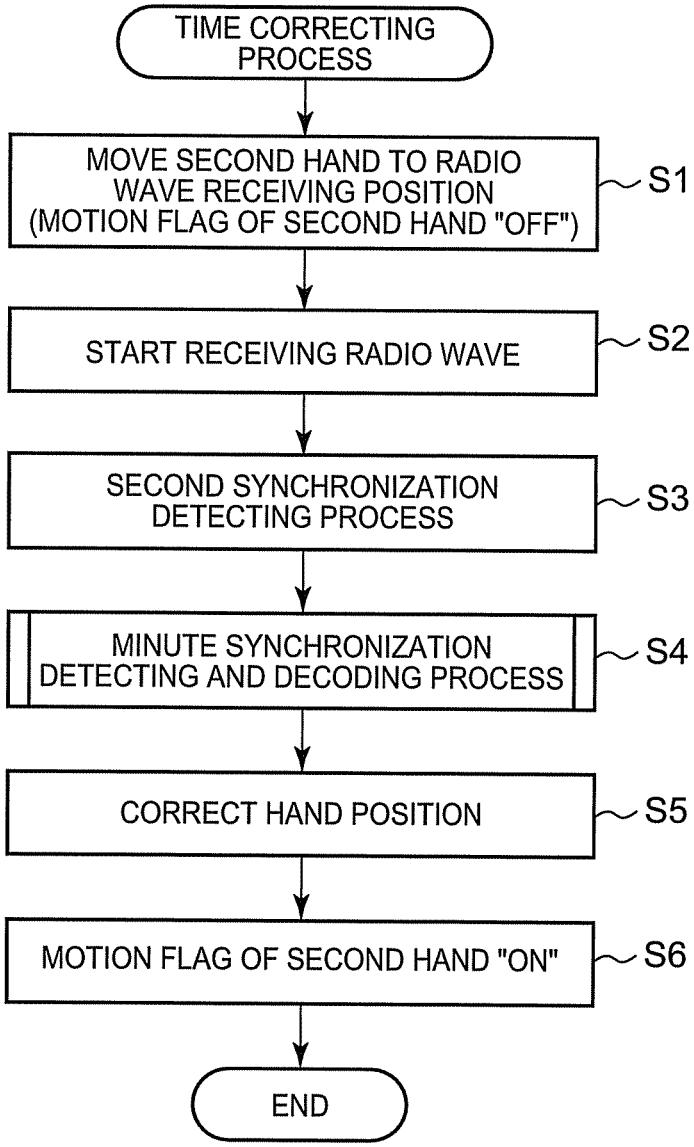
FIG. 2 is a flowchart showing control steps of a time correcting process performed by a CPU.

FIG. 2 is a flowchart of the time correcting process performed by the CPU 20.

The time correcting process starts at a preset time, or at a time when a prescribed operation command is inputted through the operation section 19.

During the time correcting process, while the second hand 2 is controlled in such a way that a motion of the second hand 2 every one second stops, the minute hand 3 and the hour hand 4 are controlled in such a way that motions of the minute hand 3 and the hour hand 4 every 10 seconds continue. Consequently, when the time correcting process starts, the CPU 20 fast-forwards the second hand 2 to a position on the dial plate, the position where it is indicated that the radio wave is being received, and then sets a motion flag of the second hand 2 in the RAM 21 to OFF (Step S1). Accordingly, the motion of the second hand 2 every one second stops. On the other hand, the motions of the minute hand 3 and the hour hand 4 every 10 seconds continue as the time displaying process is performed in parallel with the time correcting process.

Next, the CPU 20 starts a receiving process by operating the radio wave receiving circuit 12 (Step S2). Consequently, the standard radio wave is received, and a time code signal represented by a high level and a low level is supplied from the radio wave receiving circuit 12 to the CPU 20.

When the time code signal is supplied, the CPU 20 performs a second synchronization detecting process by which a synchronization point for each second (a synchronization point for each of 0.0 sec., 1.0 sec., to 59.0 sec.; a second synchronization point, hereinbelow) is detected from the time code signal (Step S3). The second synchronization detecting process is performed, for example, by sampling the time code signal for a plurality of seconds, detecting a timing at which a change of the waveform (a change from a high level to a low level in a case of the Japan standard radio wave of JJY) appears, the change which appears on a one-second cycle, and then determining the timing as the second synchronization point.

When the second synchronization point is detected, the CPU 20 performs a minute synchronization detecting and decoding process by which a synchronization point for each minute (a synchronization point for x min. 00 sec., the "x" is an arbitrary value of minutes; a minute synchronization point, hereinbelow) is determined, time data is generated by performing a code determination of the time code signal and by decoding the time code signal, and the time calculation data of the time calculating circuit 15 is corrected (Step S4). The minute synchronization detecting and decoding process is described below in detail.

When the time data is generated, and the time calculation data of the time calculating circuit 15 is corrected, if necessary, the CPU 20 fast-forwards the minute hand 3 and the hour hand 4 so as to correct the positions thereof (Step S5). Then, the CPU 20 turns the motion flag of the second hand 2 to ON in order to drive the stopped second hand 2 to revolve in synchronism with the time calculation data (Step S6), and ends the time correcting process.

[Minute Synchronization Detecting and Decoding Process]

Next, the minute synchronization detecting and decoding process performed at Step S4 is described in detail.

For the minute synchronization detecting and decoding process according to the embodiment, a normal method is not used, the method by which, in order to perform a decoding process, after the detection of the minute synchronization point is completed, the measurement of each pulse signal of the time code signal (pulse signal measurement) for the code determination is started. In the minute synchronization detecting and decoding process according to the embodiment, pulse signal measurement for the minute synchronization point detection and pulse signal measurement for the code determination are performed in parallel, and a prescribed number of detection data measured for the code determination (code determination detection data; second data) is stored. When the minute synchronization point is detected, at the time, the code determination and the decoding process are performed by using the stored code determination detection data, so that time data is generated.

When a consistency check (consistency checking process) is performed on the time data generated by the decoding process, and it is determined as "inconsistent", it is possible that the result of the minute synchronization point detection is wrong. Then, additional pulse signal measurement for the minute synchronization point detection is performed, and the minute synchronization point is re-detected. When the re-detection of the minute synchronization point is completed, in order to generate time data, the code determination and the decoding process are re-performed by using the code determination detection data stored by then.

Figure 10A:
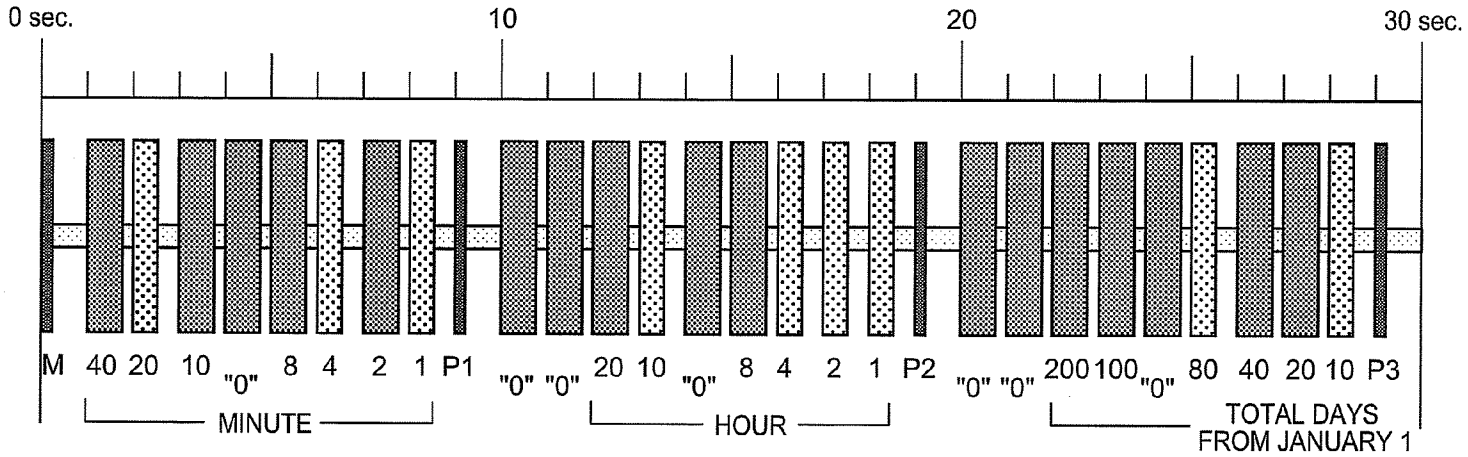
FIG. 10A, and 10B are diagrams showing a format of a time code signal included in the Japan standard radio wave.
Figure 10B:
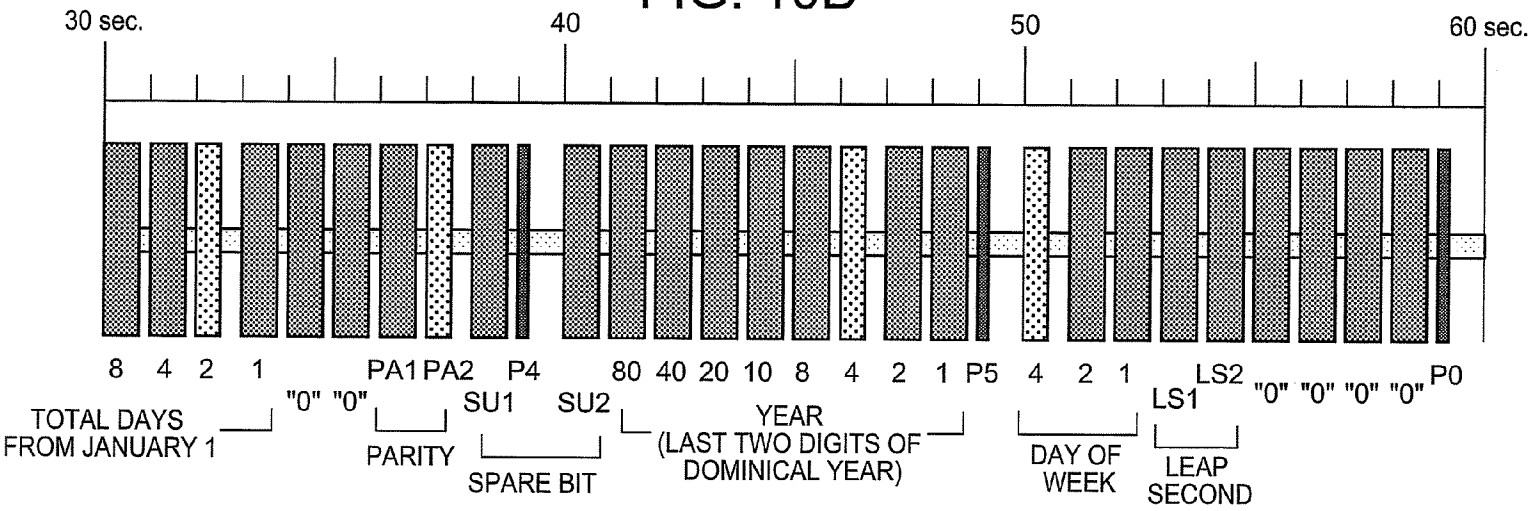

FIGS. 10A and 10B are diagrams showing the format of the time code signal included in the Japan standard radio wave.

The minute synchronization point is detected by detecting marker signals (M, P0 to P5) which are respectively disposed at prescribed positions in a frame of the time code signal as shown in FIGS. 10A and 10B. An area where two marker signals P0 and M exist in succession is determined, and of the two marker signals P0 and M, the start-end of the second marker signal, i.e. the start-end of the marker signal M, is determined as the minute synchronization point.

Figure 3:
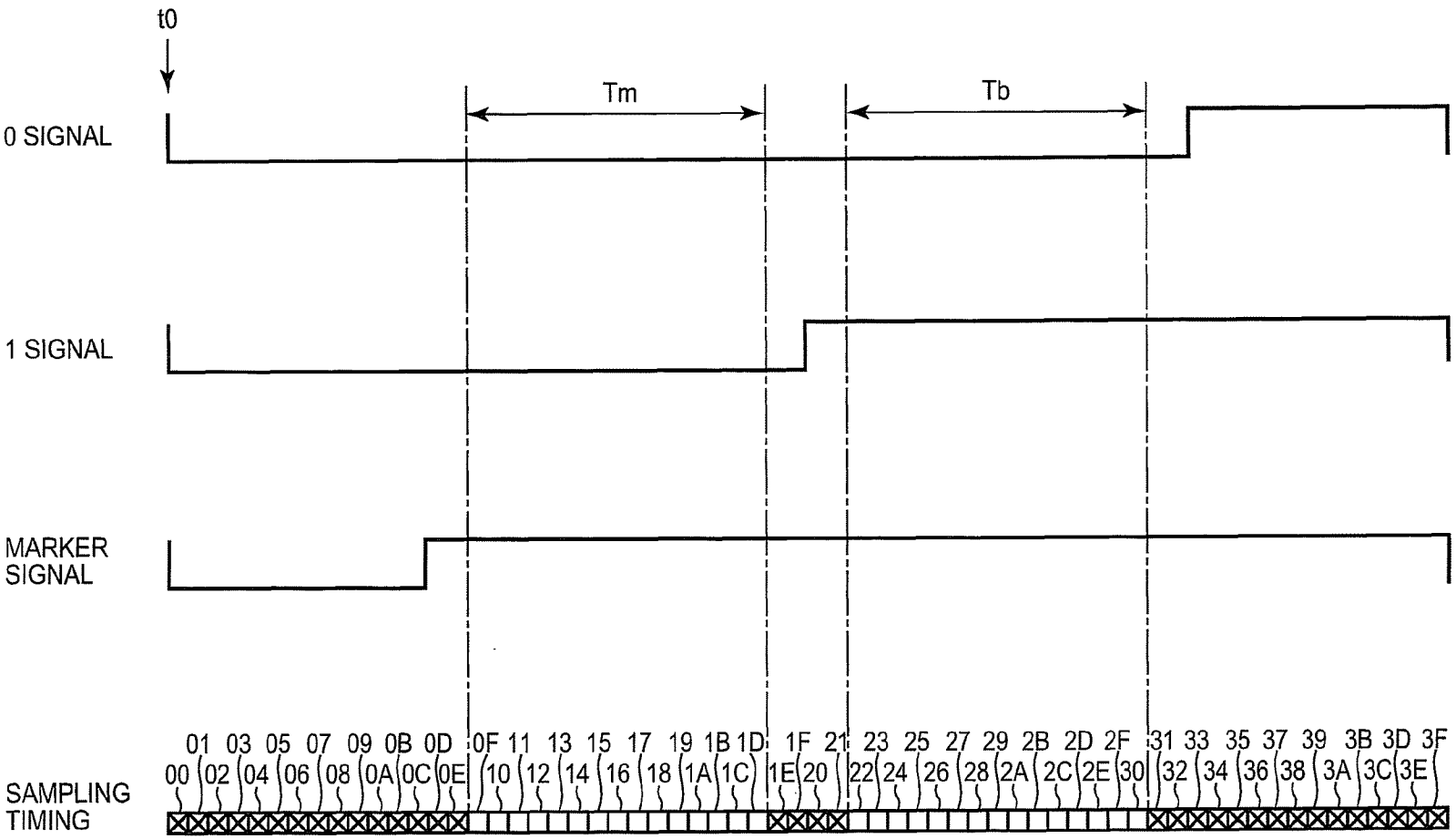
FIG. 3 is a diagram for explaining a marker characteristic interval and a signal characteristic interval in which sampling is performed.

FIG. 3 is a diagram for explaining a marker characteristic interval and a signal characteristic interval in which a sampling process is performed. FIG. 3 shows an ideal signal waveform of a 0 signal (a pulse signal representing a 0 code, i.e. a non-marker pulse signal), an ideal signal waveform of a 1 signal (a pulse signal representing a 1 code, i.e. a non-marker pulse signal), an ideal signal waveform of a marker signal (a pulse signal representing a marker, i.e. a marker pulse signal) of the time code signal. In addition, a sampling timing in FIG. 3 shows whether the sampling process is performed or not at each of the timing of 64 portions ("0x00" to "0x3F) of one second (the "X" represents that the sampling process is not performed, and the blank represents that the sampling process is performed).

As shown in FIG. 3, the pulse signal measurement for the minute synchronization point detection is performed by sampling each pulse signal at a prescribed frequency (64 Hz, for example) in a marker characteristic interval Tm where an ideal marker pulse signal is different from ideal non-marker pulse signals (a 0 signal and a 1 signal) in the signal level, so the signal level of the time code signal is detected. For example, as shown in FIG. 3, among the 64 portions "0x00 to 0x3F" into which one second starting from the second synchronization point t0 is divided, the signal level (a high level or a low level) of each pulse signal is detected at 15 portions "0x0F to 0x1D" which is the marker characteristic interval Tm.

Then, with respect to each pulse signal of the time code signal, the number of high levels (high level number) which match the signal level of the ideal marker signal is calculated. The calculated values thereof are respectively added to values in the marker detection memories M0 to M59 so as to be stored therein as the marker detection data (first data). The 60 marker detection memories M0 to M59 are respectively correlated with the 60 pulse positions of 60 pulse signals in one frame of the time code signal. Accordingly, the marker detection data of the pulse signals are added to and stored in the marker detection memories M0 to M59 which are respectively correlated with the pulse positions of the pulse signals.

Such pulse signal measurement therefor is performed on a plurality of frames of the time code signal. At the initial state, values of the marker detection memories M0 to M59 are all set to 0. Therefore, when the first frame thereof is measured, the marker detection data of pulse signals thereof are stored as they are in the marker detection memories M0 to M59, respectively. From the second frame thereof, the marker detection data of pulse signals thereof are added to the values stored in the marker detection memories M0 to M59, respectively, and the results of the addition are stored therein, respectively.

In a case where an ideal time code signal is inputted, the marker detection data of a pulse signal shows "15" as the high level number when the pulse signal is a marker signal, and "1" as the high level number when the pulse signal is a non-marker signal. Therefore, by comparing values of the marker detection memories M0 to M59 with each other, the positions of the marker signals can be identified. In a case where a normal time code signal having noise is inputted, the difference between the marker detection data of a marker signal and the marker detection data of a non-marker signal is small. Therefore, when the noise is much, it may become difficult to distinguish the marker signals from the non-marker signals based on the marker detection data. However, by adding up the marker detection data for a plurality of frames of the time code signal on a one-frame cycle, and storing the added-up values of the marker detection data in the marker detection memories M0 to M59, the influence of the noise can be reduced, and the marker signals can be easily distinguished from the non-marker signals based on the added-up values of the marker detection data.

That is, even when the minute synchronization point is wrongly detected because of the influence of the noise, by increasing the number of frames of the time code signal, the frames the pulse signals of which are to be measured, and adding up the marker detection data on a one-frame cycle, the minute synchronization point can be correctly detected thereafter.

As shown in FIGS. 10A and 10B, the decoding process is performed by performing the code determination (the 0 code or the 1 code) of pulse signals other than the marker signals M and P0 to P5 of the time code signal, and decoding code strings acquired thereby in accordance with the format of the time code signal. For the code determination of the pulse signals, the code determination detection data acquired by the pulse signal measurement for the code determination are used.

As shown in FIG. 3, the pulse signal measurement for the code determination is performed by sampling each pulse signal at a prescribed frequency (64 Hz, for example) in a signal characteristic interval Tb where an ideal 0 signal is different from an ideal 1 signal in the signal level, so that the signal level of the time code signal is detected. For example, as shown in FIG. 3, among the 64 portions "0x00 to 0x3F" into which one second starting from the second synchronization point t0 is divided, the signal level (the high level or the low level) of each pulse signal is detected at 15 portions "0x22 to 0x30" which is the signal characteristic interval Tb.

Then, for example, with respect to each pulse signal, the number of the detected high levels (high level number) is calculated. The calculated values thereof are respectively stored in the 01 distinction memories A0 to A179 in order, as the code determination detection data (second data). During the pulse signal measurement for the code determination, the minute synchronization point is not determined yet, and accordingly, the same pulse signal measurement is performed on the pulse signals which are disposed at the positions for the marker signals M and P0 to P5 too. The number of the code determination detection data which can be stored is the same as the number of the 01 distinction memories A0 to A179. That is, the code determination detection data for three frames of the time code signal can be stored. When the pulse signal measurement for the code determination continues more than three frames thereof because accurate time data is not acquired yet, new code determination detection data are cyclically stored in the 01 distinction memories A0 to A179 from the top thereof by overwriting.

The minute synchronization point is determined in a state where the code determination detection data for at least two frames of the time code signal are stored in the 01 distinction memories A0 to A179, whereby the code determination detection data from the 0s position to the 59s position of the time code signal are acquired. Accordingly, the codes for the positions where 0 signals and 1 signals are arranged can be determined, and time data can be generated based thereon. The method for the code determination is not particularly limited as long as the code of each pulse signal is determined. However, for example, the code of a pulse signal can be determined as the 1 code when the high level number is "8" or more, and determined as the 0 code when the high level number is "7" or less.

Next, an example of the minute synchronization detecting and decoding process according to the embodiment is described in detail with reference to FIGS. 4A to 4D and FIGS. 5A to 5D in order of execution.

Figure 4A:
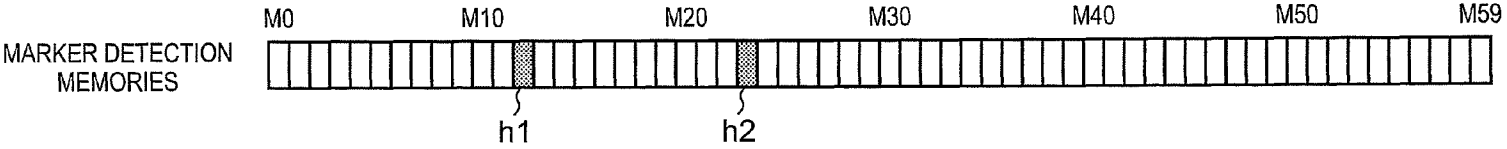
FIGS. 4A to 4D are diagrams showing contents of memories in a specific example of a minute synchronization detecting and decoding process.
Figure 4B:
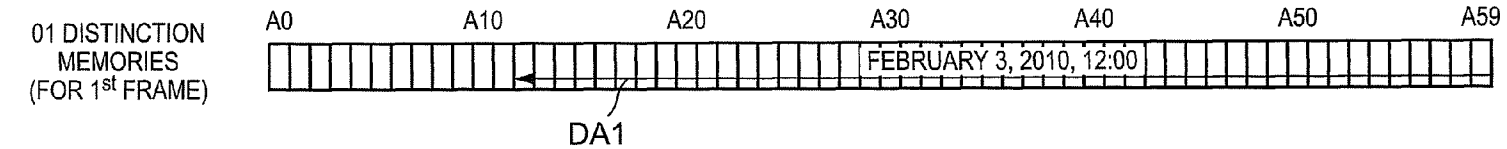
Figure 4C:
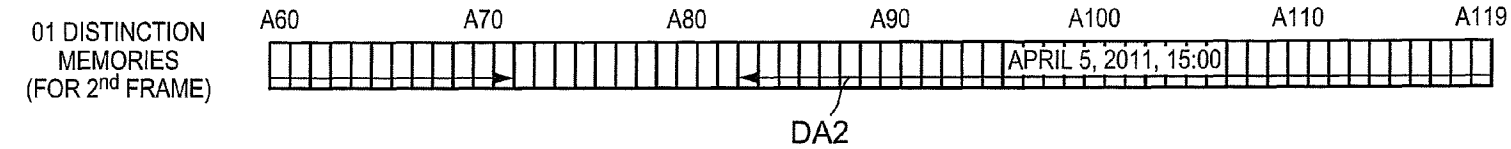
Figure 4D:
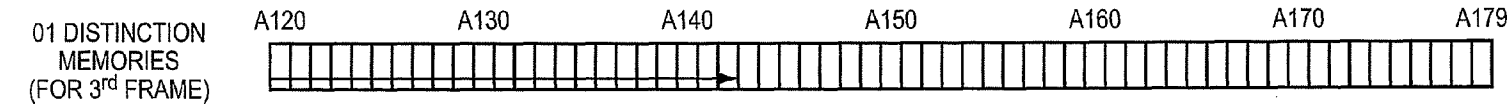

FIGS. 4A to 4D are diagrams for explaining contents of the memories in a specific example of the minute synchronization detecting and decoding process. FIGS. 5A to 5D are time charts showing the specific example of the minute synchronization detecting and decoding process. FIG. 4A shows the 60 marker detection memories M0 to M59, and FIGS. 4B to 4D show the 180 01 distinction memories A0 to A179, 60 by 60. FIGS. 5A to 5D respectively show the first minute to the fourth minute from the beginning of the minute synchronization detecting and decoding process.

When the minute synchronization detecting and decoding process begins (0s point in FIG. 5A), the pulse signal measurement for the minute synchronization point detection (the sampling process in the marker characteristic interval Tm) and the pulse signal measurement for the code determination (the sampling process in the signal characteristic interval Tb) are performed. The measurement for the minute synchronization point detection and the measurement for the code determination continue until time data is generated and the time data is determined as "consistent" ("Reception Succeeded" in FIG. 5D).

By these processes, the marker detection data each of which shows the number of the high levels detected from a pulse signal in the marker characteristic interval Tm are added to and stored in the marker detection memories M0 to M59. In addition, the code determination detection data each of which shows the number of high levels detected from each pulse signal in the signal characteristic interval Tb are stored in the 01 distinction memories A0 to A179.

When two minutes pass from the beginning of the minute synchronization detecting and decoding process (timing A in FIG. 5B), the marker detection data for two frames of the time code signal are accumulated in the marker detection memories M0 to M59, and the minute synchronization point is detected by using the accumulated marker detection data. In the example shown in FIGS. 4A and 5A, large values appear in two consecutive marker detection memories M11 and M12, and the $12^{th}$ second is detected as the minute detection point (h1), accordingly.

When the minute detection point is detected, the code determination of the time code signal is performed during the following period (period B in FIG. 5C) by using the code determination detection data stored in the 01 distinction memories A0 to A179. Then, time data is generated based on the determined code strings. At the time, the latest code determination detection data for two frames thereof are stored in the 01 distinction memories A0 to A119, so that time data is generated by using the code determination detection data DA1 for one frame starting from the minute synchronization point (h1) among the code determination detection data. In the example shown in FIGS. 4B and 4C, the time data "Feb. 3, 2010, 12:00" is generated based on the code determination detection data DA1.

Immediately after the time data is generated (timing C in FIG. 5C), the consistency check of the time data is performed. For example, for the first and the second consistency checks, the time data is compared with the time calculation data of the time calculating circuit 15. When a time difference therebetween is within a prescribed range (±30 sec., for example), the time data is determined as "consistent", and when out of the range, the time data is determined as "inconsistent". For the third consistency check, the time data is compared with the time data generated last time and the time data generated last time but one. When there is a time difference of one minute between each two consecutive time data, the time data are determined as "consistent", and when not, the time data are determined as "inconsistent". In the example in FIG. 5C, the time data is/are determined as "inconsistent" (Reception Failed) by the consistency check at the timing C.

When the time data is determined as "inconsistent" (Reception Failed), the pulse signal measurement for the minute synchronization point detection and the pulse signal measurement for the code determination continue for another one frame of the time code signal. When the process for the one frame is completed (timing D in FIG. 5C), the marker detection data for three frames thereof are accumulated in the marker detection memories M0 to M59, and the minute synchronization point is re-detected by using the accumulated marker detection data. In the example in FIGS. 4A and 5B, large values appear in two consecutive marker detection memories M22 and M23, and the $23^{rd}$ second is detected as the minute detection point (h2).

When the minute detection point is detected, the code determination of the time code signal is performed again during the following period (period E in FIG. 5D) by using the code determination detection data stored in the 01 distinction memories A0 to A179. Then, the time data is generated based on the determined code string. At the time, the code determination detection data for three frames are stored in the 01 distinction memories A0 to A179, so that time data is generated by using the code determination detection data DA2, i.e. the latest code determination detection data for one frame starting from the minute synchronization point (h2) among the code determination detection data. In the example shown in FIGS. 4C and 4D, the time data "Apr. 5, 2011, 15:00" is generated based on the code determination detection data DA2.

Immediately after the time data is generated (timing F in FIG. 5D), the consistency check of the time data is performed again. In the example in FIG. 5D, the time data is determined as "consistent" (Reception Succeeded) by the consistency check at the timing F. When the time data is determined as "consistent" (Reception Succeeded), the marker detection data and the code determination detection data thereafter are not needed, and hence the pulse signal measurement for the minute synchronization point detection and the pulse signal measurement for the code determination stop.

When the time data is determined as "consistent" (Reception Succeeded), an adjusting process is performed, the adjusting process by which the time calculation data of the time calculating circuit 15 is corrected. That is, first, a good timing to correct the time calculation data thereof, for example, a timing which is in a few seconds after the time data is determined as "consistent", and has no tenth of a second (timing G in FIG. 5D), is set as an adjustment timing (correction timing). Next, since the time data determined as "consistent" indicates the time of a one-frame period starting from the minute synchronization point (h2), a time difference between the minute synchronization point (h2) and the adjustment timing G is added to the generated time data, and setup time data at the adjustment timing G is calculated. Then, the time calculation data of the time calculating circuit 15 is corrected to the setup time data at the adjustment timing G. By this process, the minute synchronization detecting and decoding process ends.

Figure 6:
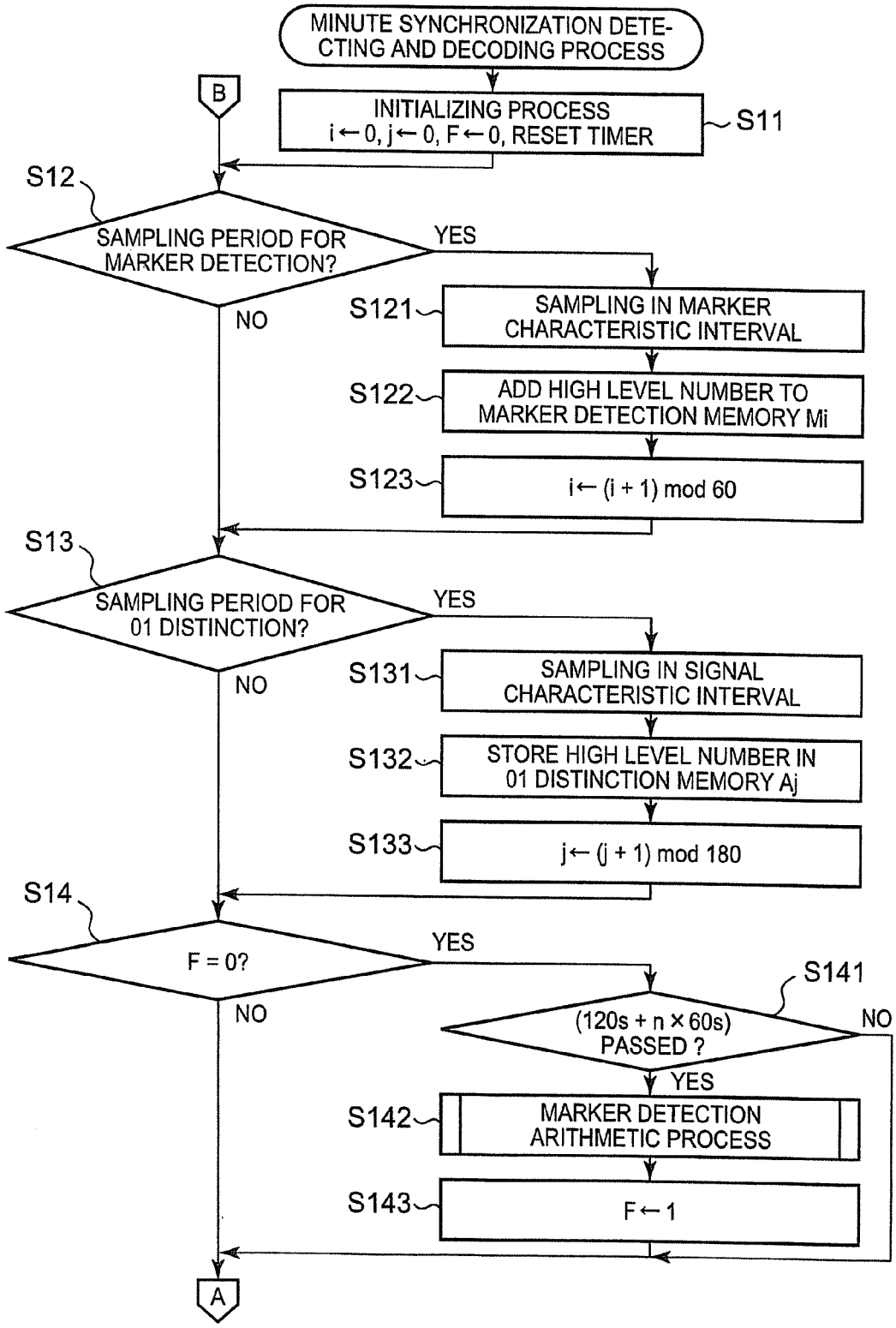
FIG. 6 is the first part of a flowchart showing control steps of the minute synchronization detecting and decoding process performed at Step S4 in FIG. 2.
Figure 7:
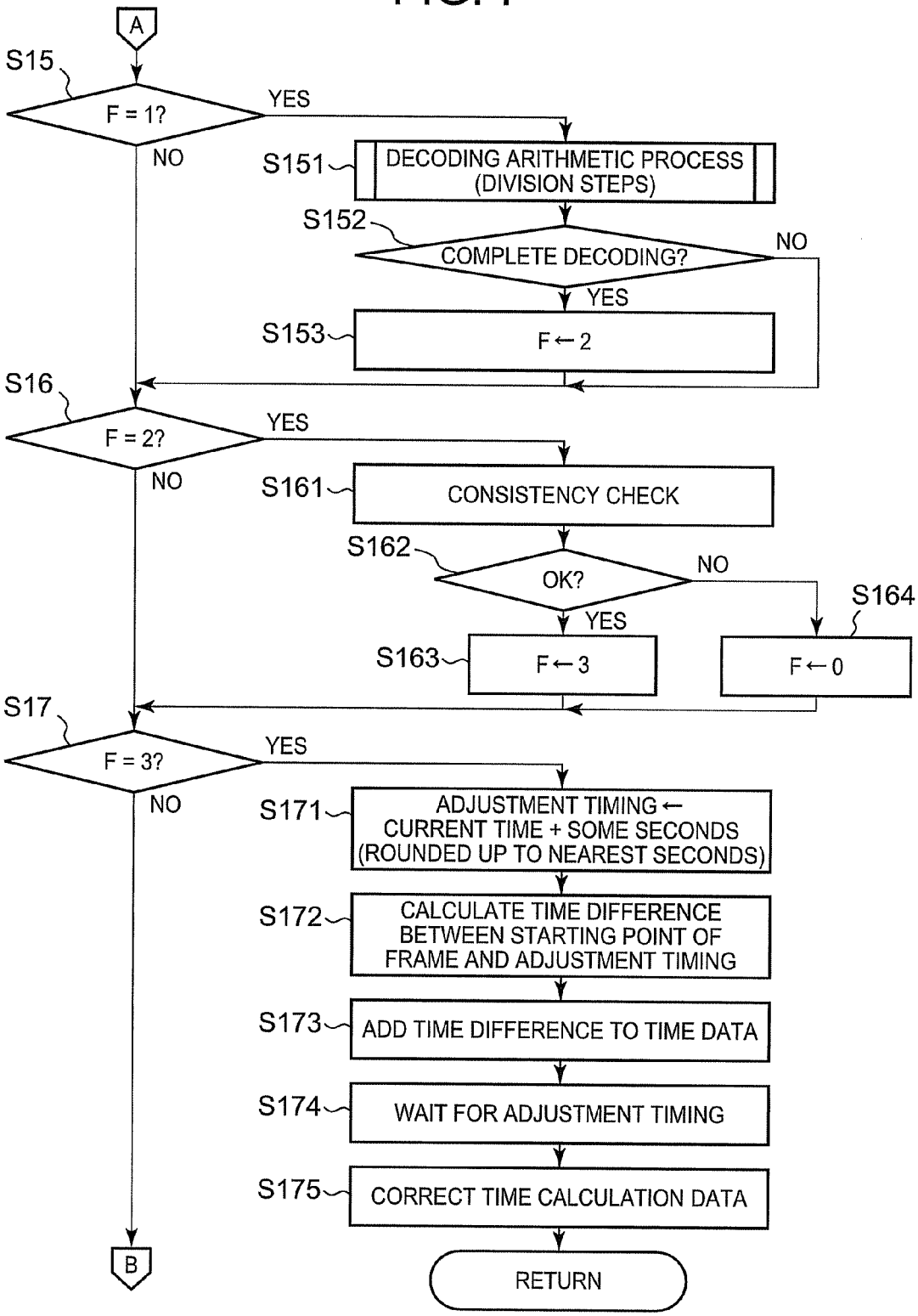
FIG. 7 is the second part of the flowchart showing control steps of the minute synchronization detecting and decoding process.
Figure 8:
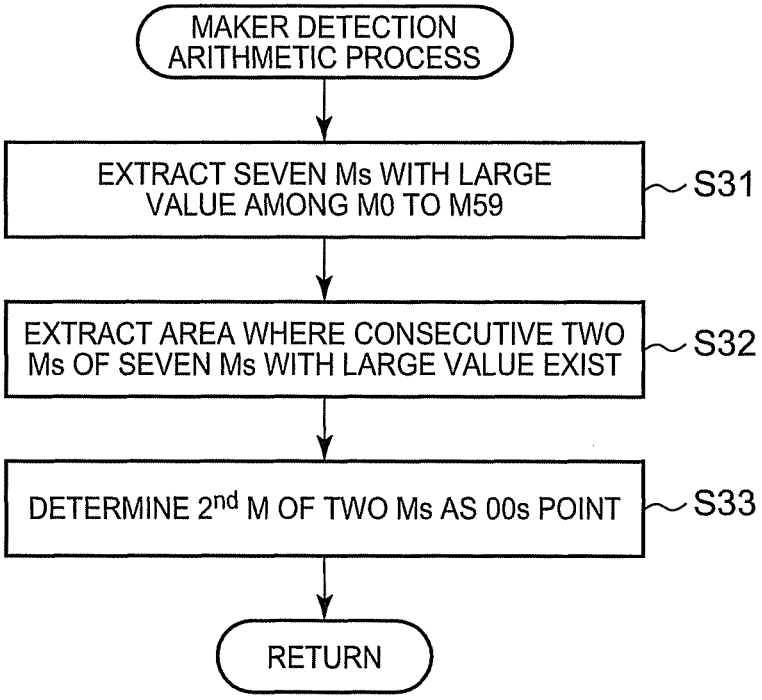
FIG. 8 is a flowchart showing control steps of a marker detection arithmetic process performed at Step S142 in FIG. 6.
Figure 9:
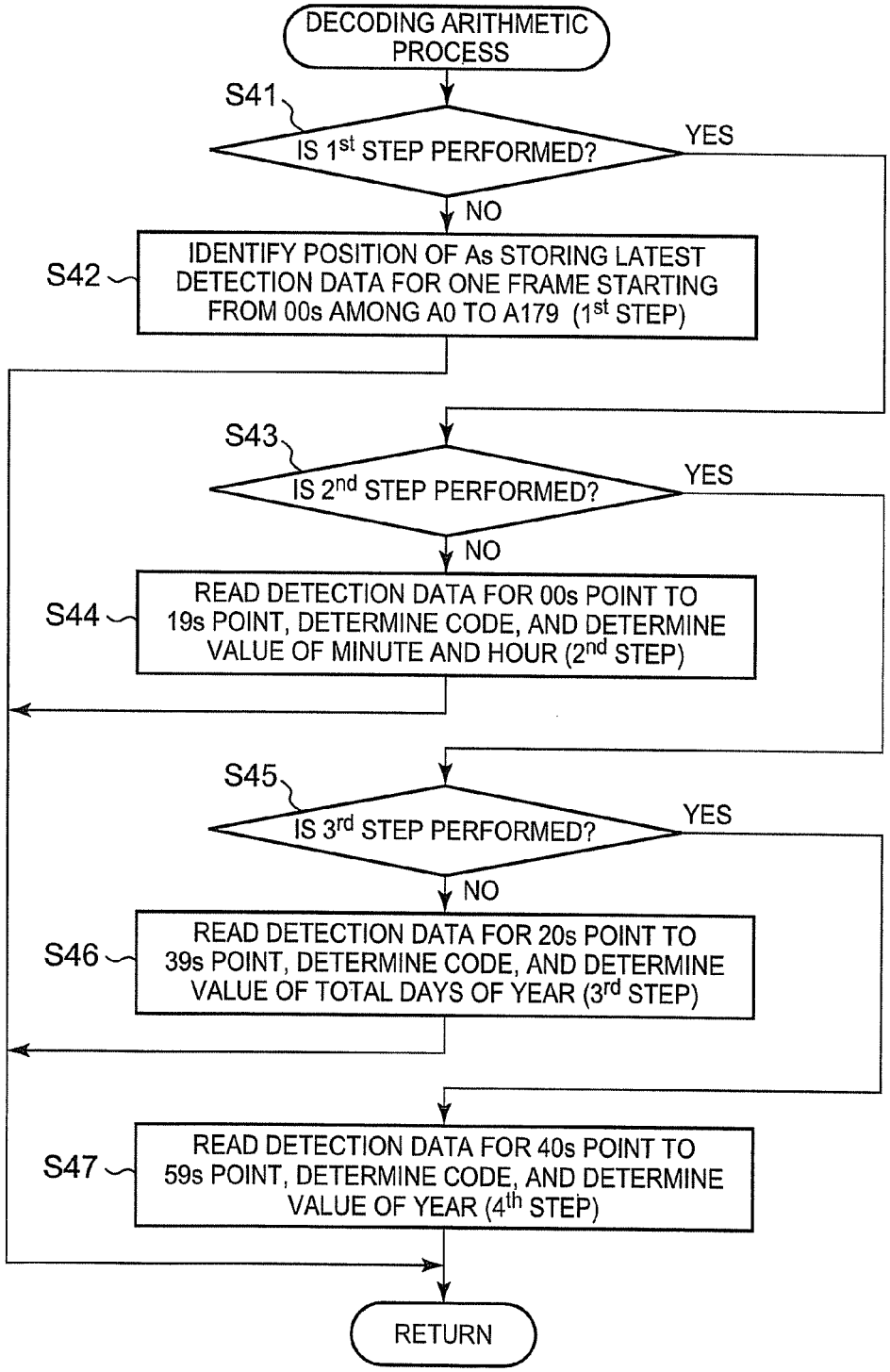
FIG. 9 is a flowchart showing control steps of a decoding arithmetic process performed at Step S151 in FIG. 7.

FIGS. 6 and 7 show a flowchart of the minute synchronization detecting and decoding process performed at Step S4 in FIG. 2. FIG. 8 shows a flowchart of a marker detection arithmetic process performed at Step S142 in FIG. 6. FIG. 9 shows a flowchart of a decoding arithmetic process performed at Step S151 in FIG. 7.

The minute synchronization detecting and decoding process described above is achieved by the control steps shown in FIGS. 6 to 9, for example. In the flowchart shown in FIGS. 6 and 7, a variable i indicates a number of a marker detection memory to which a pulse signal corresponds among the 60 marker detection memories M0 to M59, the pulse signal which is subjected to the sampling process, a variable j indicates a number of a 01 distinction memory in which the code determination detection data of the pulse signal acquired by the sampling process is stored among the 01 distinction memories A0 to A179, and a variable F indicates a current process status.

When the CPU 20 moves to the minute synchronization detecting and decoding process, the CPU 20 performs an initializing process such as setting default values to various variables used for the process, resetting a timer which counts the time from the beginning of the process, and making the frequency dividing circuit 14 to supply a prescribed timing signal (Step S11). By the initializing process, the variables j, and F are all set to "0", and the frequency dividing circuit 14 is set to supply a first timing signal which informs the start of the sampling process (230 ms from the second synchronization point t0) for the marker detection, a second timing signal which informs the start of the sampling process (530 ms from the second synchronization point t0) for the code determination, and a 64 Hz timing signal which informs a sampling cycle.

When ending the initializing process, the CPU 20 moves to a loop process of judging processes performed at Steps S12 to S17, and selectively performs processes in accordance with timings. At Step S12, it is judged whether or not the first timing signal which informs the start of the sampling process for the marker detection is inputted. At Step S13, it is judged whether or not the second timing signal which informs the start of the sampling process for the code determination is inputted. At Step S14, it is judged whether or not the variable F is "0" which indicates that this point in time is before the detection of the minute synchronization point. At Step S15, it is judged whether or not the variable F is "1" which indicates that this point in time is after the detection of the minute synchronization point and under the decoding process. At Step S16, it is judged whether or not the variable F is "2" which indicates that this point in time is after the decoding process and before the consistency check. At Step S17, it is judged whether or not the variable F is "3" which indicates that this point in time is after the generation of the time data having consistency and before the adjusting process.

By the loop process of Steps S12 to S17, with respect to each pulse signal thereof, during its sampling period, the sampling process is performed on the pulse signal, and out of the sampling period, other control processes are performed.

That is, when the first timing signal is inputted, and hence the judgment is "YES" in the judging process performed at Step S12, the CPU 20 moves to the "YES" side in FIG. 6. This point in time is the timing which is almost the start-end of the marker characteristic interval Tm (See FIG. 3). Therefore, CPU 20 first detects the signal level of the time code signal for the 15 portions in synchronism with the 64 Hz timing signal (Step S121: a first data acquiring section). Then, the CPU 20 counts the number of the high levels detected from the 15 portions, and a value thereof is added to and stored in the marker detection memory Mi (Step S122: a first data storing section). Next, the CPU 20 updates the variable i by "+1" so that the variable i corresponds to its next pulse signal (Note that when the variable i reaches "60", it is reset to "0".) (Step S123).

When the second timing signal is inputted, and hence the judgment is "YES" in the judging process performed at Step S13, the CPU 20 moves to the "YES" side in FIG. 6. This point in time is the timing which is almost the start-end of the signal characteristic interval Tb (See FIG. 3). Therefore, CPU 20 first detects the signal level of the time code signal for the 15 portions in synchronism with the 64 Hz timing signal (Step S131: a second data acquiring section). Then, the CPU 20 counts the number of the high levels detected from the 15 portions, and a value thereof is stored in the 01 distinction memory Aj by overwriting (Step S132: a second data storing section). Next, the CPU 20 updates the variable j by "+1" so that the variable j corresponds to its next pulse signal (Note that when the variable j reaches "180", it is reset to "0") (Step S133).

While the minute synchronization detecting and decoding process is being performed (a period when the variable F is not "3"), Steps S121 to S123 and Steps S131 to S133 are repeatedly performed on a one-second cycle, and consequently, the marker detection data and the code determination detection data are accumulated in the marker detection memories M0 to M59 and the 01 distinction memories A0 to A179.

On the other hand, when it is neither in the marker characteristic interval Tm nor in the signal characteristic interval Tb, processes are performed in accordance with the variable F which indicates the process status. At the beginning of the minute synchronization detecting and decoding process, the variable F is "0" which indicates that this point in time is before the detection of the minute synchronization point. Hence, the judgment is "YES" in the judging process performed at Step S14, and the CPU moves to the "YES" side in FIG. 6. Then, the CPU 20 checks a value of the timer which counts the time from the beginning of the minute synchronization detecting and decoding process, and judges whether or not this is the timing for the detection of the minute synchronization point, the timing which is 120 s, 180 s, 240 s, or the like (Step S141). When it is judged that this is not the timing (Step S141; NO), the CPU 20 returns to the loop process of Steps S12 to S17.

On the other hand, when it is judged that this is the timing for the detection of the minute synchronization point (Step S141; YES), the CPU 20 performs the marker detection by using the marker detection data of the marker detection memories M0 to M59, and performs a marker detection arithmetic process for determining the minute synchronization point (Step S142). Then, the CPU 21 updates the variable F, which indicates the process status, to "1" (Step S143), and returns to the loop process of Steps S12 to S17.

That is, by Steps S141 to S143, the minute synchronization point detecting process at the timing A in FIG. 5B and the timing D in FIG. 5C is achieved, Taking Steps S141 and S142 makes up a detecting section.

The marker detection arithmetic process at Step S142 is performed by taking the following steps shown in FIG. 8. First, the CPU 20 extracts seven marker detection memories among the memories M0 to M59, the seven marker detection memories values of which are large, which indicates the positions of the marker signals (Step S31). Next, the CPU 20 extracts an area where two of the seven marker detection memories exist consecutively (Step S32). Then, the CPU 20 determines the pulse position corresponding to the second marker detection memory of the two consecutive marker detection memories as the start of a frame of the time code signal, namely, 00 sec. (Step S33).

When the variable F is "1" which indicates that this point in time is after the detection of the minute synchronization point and before the decoding process, and hence the judgment is "YES" in the judging process at Step 15, the CPU 20 moves to the "YES" side in FIG. 7. Then, the CPU 20 first performs the decoding arithmetic process by which time data is generated by using the code determination detection data of the 01 distinction memories A0 to A179 (Step S151: a decoder). However, the decoding arithmetic process takes a long time in total, and hence if the decoding arithmetic process is performed all at once, the marker characteristic interval Tm and the signal characteristic interval Tb may be missed. Therefore, at Step S151, division steps into which the decoding arithmetic process is divided are performed step by step.

When the division steps of the decoding arithmetic process are performed, the CPU 20 judges whether or not the decoding process is completed (Step S152). When it is judged that the decoding process is not completed yet, the CPU 20 returns to the loop process of Steps S12 to S17. On the other hand, when it is judged that the decoding process is completed, the CPU 20 updates the variable F, which indicates the process status, to "2" (Step S153), and returns to the loop process of Steps S12 to S17.

That is, when the variable F is "1", the sampling process is performed at the timing for the marker characteristic interval Tm and the signal characteristic interval Tb, and when out of the period, the division steps of the decoding arithmetic process at Step S151 are repeatedly performed, so that time data is generated. By Steps S15 and S151 to S153, the time data generating process in the period E in FIG. 5C and the period E in FIG. 5D are achieved.

The decoding arithmetic process at Step S151 is repeatedly performed by judging processes at Steps S41, S43, and S45 in FIG. 9. That is, by the judging processes at Steps S41, S43, and S45, processes at the first step (Step S42), the second step (Step S44), the third step (Step S46) and the fourth step (Step S47) of the decoding arithmetic process are performed in order, the first to fourth steps thereof into which the decoding arithmetic process, a series of processes, is divided.

At the first step thereof (Step S42), the CPU 20 identifies, from among the 01 distinction memories A0 to A179, the positions of the 01 distinction memories in which the code determination detection data for the latest one frame starting from the 00 s point (00 second) are stored, based on the result of the detection of the minute synchronization point and a value of the variable i. At the second step thereof (Step S44), the CPU 20 reads the code determination detection data for the 00 s point to the 19 s point from among the 01 distinction memories A0 to A179 based on the positions of the 01 distinction memories identified at Step S42, and the code determination is performed in order to determine a value of the minute and a value of the hour.

At the third step thereof (Step S46), the CPU 20 reads the code determination detection data for the 20 s point to the 39 s point from among the 01 distinction memories A0 to A179 based on the positions of the 01 distinction memories identified at Step S42, and the code determination is performed in order to determine a value of the total days of a year. At the fourth step thereof (Step S47), the CPU 20 reads the code determination detection data for the 40 s point to the 59 s point from among the 01 distinction memories A0 to A179 based on the positions of the 01 distinction memories identified at Step S42, and the code determination is performed in order to determine a value of the year.

By such processes, the decoding arithmetic process at Step S151 in FIG. 7 is performed a plurality of times (four times, in the embodiment), whereby the decoding process is completed one time, and time data is generated, accordingly.

When the variable F is "2" which indicates that this point in time is after the decoding process, and hence the judgment is "YES" in the judging process at S16, the CPU 20 moves to the "YES" side in FIG. 7. Then, the CPU 20 performs the consistency check of the time data generated by the decoding process (Step S161: a consistency determining section). The details of the consistency check are described above.

Then, the CPU 20 determines whether or not the result of the consistency check is "OK (consistent)" or "NO (inconsistent)" (Step S162). When the result is "OK", the CPU 20 updates the variable F to "3" so as to advance the minute synchronization detecting and decoding process (Step S163). On the other hand, when the result is "NO", the CPU 20 updates the variable F to "0" so as to return to the minute synchronization point detecting process (Step S164).

That is, by Steps S161 to S164, the consistency checking process at the timing C in FIG. 5C and the timing F in FIG. 5D is achieved. Also, based on the result of the consistency check, it is decided whether to move to the adjusting process or to return to the minute synchronization point detecting process.

When the number of the determines "NO" in the consistency check of the generated time data reaches a prescribed number, the minute synchronization detecting and decoding process may be ended by judging that an error occurs.

In the loop process of Steps S12 to S17 in FIGS. 6 and 7, when the variable F is "3" which indicates that this point in time is before the adjusting process, and hence the judgment is "YES" at Step S17, the CPU 20 moves to the "YES" side in FIG. 7, and escapes from the loop process of Steps S12 to S17, accordingly.

Then, the CPU 20 sets the adjustment timing (timing G in FIG. 5D, for example) (Step S171: a correction timing setting section). As the adjustment timing, a timing is set, the timing which is a few seconds later from the current time calculated by the time calculating section 15, and which is rounded down to the nearest seconds. Then, the CPU 20 generates setup time data by calculating a time difference from the starting point of the frame of the time code signal to the adjusting timing, the frame which is subjected to the decoding process (Step S172: a generating section), and by adding the time difference to the acquired time data (Step S173: a generating section).

Next, the CPU 20 waits until the time calculated by the time calculating circuit 15 reaches the adjustment timing (Step S174: a time setting section), and at the adjustment timing, overwrites the time calculation data of the time calculating section 15 by the setup time data generated at Step S173 so as to correct the time calculation data thereof (Step S175: a time setting section). Taking Steps S171 to S175 makes up a time correcting section.

By the control steps, the minute synchronization detecting and decoding process described above with reference to the timing charts in FIGS. 5A to 5D is achieved.

As described above, according to the radio-controlled timepiece 1 and the minute synchronization detecting and decoding process of the embodiment, the pulse signal measurement for the minute synchronization point detection (the sampling in the marker characteristic interval Tm, to be more specific) and the pulse signal measurement for the code determination (the sampling in the signal characteristic interval Tb, to be more specific) are performed in parallel, and when the minute synchronization point is detected, the code determination of the time code signal and the generation of the time data are performed by using the code determination detection data stored in the 01 distinction memories A0 to A179 by then. Accordingly, as compared with a case where after the minute synchronization point is detected, the process for the code determination is performed from the beginning, time date can be promptly generated.

Furthermore, when the time data is determined as "inconsistent" by the consistency check, additional pulse signal measurement for the minute synchronization point detection is performed, and the minute synchronization point is re-detected. Also, at the time the minute synchronization point is detected, the code determination of the time code signal and the generation of the time data are performed by using the code determination detection data stored in the 01 distinction memories A0 to A179 by then. Accordingly, even in a case where accurate time data is not acquired because the minute synchronization point is wrongly detected, when a period of time which is necessary to re-detect the minute synchronization point elapses, time data is promptly re-generated, and hence accurate time data (time information) is promptly acquired, accordingly.

Furthermore, according to the minute synchronization detecting and decoding process of the embodiment, pulse signals of two frames of the time code signal are measured from the beginning of the minute synchronization detecting and decoding process, and the minute synchronization point is detected first time based on the acquired marker detection data. Thereafter, when the time data is determined as "inconsistent", pulse signals of additional one frame of the time code signal are measured, and the minute synchronization point is detected second time based on the marker detection data including the marker detection data for the additional one frame thereof. Consequently, time data is generated in the shortest period of time, and when accurate time data is generated, the time data is determined as "consistent" by the consistency check. Accordingly, accurate time data can be promptly acquired.

Furthermore, according to the minute synchronization detecting and decoding process of the embodiment, when the minute synchronization point is detected, the decoding process of the time code signal can be performed on a one-frame cycle based on, among the code determination detection data stored in the 01 distinction memories A0 to A179, the code determination detection data starting from the minute synchronization point. Accordingly, compared with a case where the decoding process of the time code signal is performed based on code strings for one frame which starts from the middle of the frame, parity check of the time code and/or the decoding process thereof can be performed by a simple process.

Furthermore, according to the minute synchronization detecting and decoding process of the embodiment, when the time data determined as "consistent" (time information) is acquired, the adjustment timing is set at a timing is acquired, the timing when a prescribed period of time elapses after the accurate time data, and a time difference between the adjustment timing and the starting point of the frame of the time code signal is calculated, the frame from which the time data is generated. Then, the setup time data is generated by adding the time difference to the acquired time data. Thereafter, the time calculation data of the time calculating circuit 15 is corrected to the setup time data when the adjustment timing arrives. Accordingly, even when time data is generated based on the code determination detection data of the time code signal which is previously inputted, and accordingly, the generated time data indicates the time when the time code signal is inputted, the time calculation data of the time calculating circuit 15 can be accurately corrected to the current time.

The present invention is not limited to the embodiment described above, and hence can be modified variously. For example, in the embodiment, as the configuration to detect the minute synchronization point, it is described that the sampling in the marker characteristic interval Tm is performed on pulse signals of the time code signal; the number of high levels which match the signal level of the ideal marker signal is stored in each of the marker detection memories M0 to M59 as the marker detection data; such detection data are acquired for a plurality of frames of the time code signal, and the acquired marker detection data are added up on a one-frame cycle; and the positions of the marker signals are determined based on the added-up values of the marker detection data. However, this is not a limit, and various known technologies for detecting the minute synchronization point may be adopted.

Furthermore, as for the configuration to generate time data from the time code signal, as long as time data is generated from the code determination detection data acquired by measuring pulse signals of the time code signal while the minute synchronization point is detected, with respect to the method of the pulse signal measurement and the method of the code determination, various known technologies may be adopted. Furthermore, in the embodiment, one time data is generated by using the code determination detection data for one frame of the time code signal. However, as long as the code determination detection data for a plurality of frames thereof are stored, one time data may be generated by using the code determination detection data for a plurality of frames thereof.

Furthermore, in the embodiment, the code determination detection data for three frames of the time code data can be stored in the 01 distinction memories A0 to A179. However, the number of frames, i.e. the frame length, to be stored is not limited thereto. The details of the present invention shown in the embodiment can be appropriately modified without departing from the scope of the present invention.

This application is based upon and claims the benefit of priority under 35 USC 119 of Japanese Patent Application No. 2010-168827 filed on Jul. 28, 2010, the entire disclosure of which, including the description, claims, drawings, and abstract, is incorporated herein by reference in its entirety.

What is claimed is:

1. A time information acquiring apparatus comprising:

a first data acquiring section which acquires a first data for detecting a starting point of a frame of a time code signal by measuring pulse signals of the frame of the time code signal which is extracted from a standard radio wave so as to be inputted;

a first data storing section which stores the first data acquired by the first data acquiring section;

a detecting section which detects the starting point of the frame of the time code signal based on the first data stored in the first data storing section;

a second data acquiring section which acquires a second data for distinguishing the pulse signals from each other by measuring the pulse signals of the frame of the time code signal during a period of time including a period of time the first data acquiring section acquires the first data;

a second data storing section which stores the second data acquired by the second data acquiring section;

a decoder which decodes a series of code strings of the time code signal based on information on the starting point of the frame of the time code signal, the information which is acquired by detecting the starting point of the frame by the detecting section, and based on the second data stored in the second data storing section, so as to generate time data;

a consistency determining section which determines consistency of the time data generated by the decoder; and a controller which, when the generated time data is determined as inconsistent by the consistency determining section, makes the detecting section re-detect the starting point of the frame, and makes the decoder re-generate the time data based on the re-detected starting point of the frame, second data newly stored in the second data storing section, and the second data used when the generated time data is determined as inconsistent.

2. The time information acquiring apparatus according to claim 1, wherein the controller makes the detecting section detect the starting point of the frame based on at least two frames of the frames of the time code signal, and when the generated time data is determined as inconsistent, the controller makes the detecting section re-detect the starting point of the frame by adding another one frame of the frames to the at least two frames.

3. A radio-controlled timepiece comprising:

the time information acquiring apparatus according to claim 2, the time information acquiring apparatus to which the time code signal is inputted so as to acquire time information;

a time calculating section which calculates time;

a time displaying section which displays the time;

a radio wave receiving section which receives the standard radio wave so as to output the time code signal; and a time correcting section which corrects time calculation data of the time calculating section based on the time information acquired by the time information acquiring apparatus.

4. The time information acquiring apparatus according to claim 1, wherein the decoder generates the time data based on the second data which starts from the starting point of the frame, the starting point which is detected by the detecting section, from among the second data which is acquired by the second data acquiring section and stored in the second data storing section while the starting point of the frame is detected by the detecting section.

5. A radio-controlled timepiece comprising:

the time information acquiring apparatus according to claim 4, the time information acquiring apparatus to which the time code signal is inputted so as to acquire time information;

a time calculating section which calculates time;

a time displaying section which displays the time;

a radio wave receiving section which receives the standard radio wave so as to output the time code signal; and a time correcting section which corrects time calculation data of the time calculating section based on the time information acquired by the time information acquiring apparatus.

6. The time information acquiring apparatus according to claim 1 further comprising:

a time calculating section which calculates time; and a time correcting section which corrects time calculation data of the time calculating section when the time data determined as consistent by the consistency determining section is acquired, the time correcting section including:

a correction timing setting section which, when the time data determined as consistent is acquired, sets a correction timing for the time calculation data, the timing which is within a prescribed period of time after the time data determined as consistent is acquired;

a generating section which generates setup time data by adding, to the time data determined as consistent, a time difference between the correction timing and the starting point of the frame of the time code signal, the frame from which the time data determined as consistent is generated; and a time setting section which sets the setup time data generated by the generating section as the time calculation data at the correction timing.

7. A radio-controlled timepiece comprising:

the time information acquiring apparatus according to claim 6;

a time displaying section which displays the time; and a radio wave receiving section which receives the standard radio wave so as to output the time code signal.

8. A radio-controlled timepiece comprising:

the time information acquiring apparatus according to claim 1, the time information acquiring apparatus to which the time code signal is inputted so as to acquire time information;

a time calculating section which calculates time;

a time displaying section which displays the time;

a radio wave receiving section which receives the standard radio wave so as to output the time code signal; and a time correcting section which corrects time calculation data of the time calculating section based on the time information acquired by the time information acquiring apparatus.

9. A time information acquiring apparatus comprising:

a detecting section which detects a starting point of a frame of a time code signal extracted from a standard radio wave by distinguishing pulse signals of the frame of the time code signal from each other;

a second data acquiring section which acquires a second data for distinguishing the pulse signals from each other by measuring the pulse signals of the frame of the time code signal during a period of time including a period of time the detecting section detects the starting point of the frame;

a second data storing section which stores the second data acquired by the second data acquiring section;

a decoder which decodes a series of code strings of the time code signal based on information on the starting point of the frame of the time code signal, the information which is acquired by detecting the starting point of the frame by the detecting section, and based on the second data stored in the second data storing section, so as to generate time data;

a consistency determining section which determines consistency of the time data generated by the decoder; and a controller which, when the generated time data is determined as inconsistent by the consistency determining section, makes the detecting section re-detect the starting point of the frame, and makes the decoder re-generate the time data based on the re-detected starting point of the frame, second data newly stored in the second data storing section, and the second data used when the generated time data is determined as inconsistent.

* * * * *